US007040866B2

(12) United States Patent
Gagner

(10) Patent No.: US 7,040,866 B2
(45) Date of Patent: May 9, 2006

(54) SYSTEM FOR RETAINING AN ANNULAR PLATE AGAINST A RADIAL FACE OF A DISK

(75) Inventor: Patrick Gagner, Savigny le Temple (FR)

(73) Assignee: Snecma Moteurs, Paris (FR)

( * ) Notice: Subject to any disclaimer, the term of this patent is extended or adjusted under 35 U.S.C. 154(b) by 263 days.

(21) Appl. No.: 10/756,456

(22) Filed: Jan. 14, 2004

(65) Prior Publication Data

US 2005/0175459 A1 Aug. 11, 2005

(30) Foreign Application Priority Data

Jan. 16, 2003 (FR) ..... 03 00436

(51) Int. Cl.
*F01D 5/32* (2006.01)

(52) U.S. Cl. ..... 416/220 R

(58) Field of Classification Search ..... 416/220 R, 416/221

See application file for complete search history.

(56) References Cited

U.S. PATENT DOCUMENTS

| | | | | |
|---|---|---|---|---|
| 4,304,523 | A | 12/1981 | Corsmeier et al. | |
| 4,803,893 | A * | 2/1989 | Bachinski | 464/180 |
| 5,018,943 | A * | 5/1991 | Corsmeier et al. | 416/144 |
| 5,330,324 | A | 7/1994 | Agram et al. | |
| 5,472,313 | A | 12/1995 | Quinones et al. | |
| 6,106,234 | A * | 8/2000 | Gabbitas | 416/221 |
| 2002/0018719 | A1 | 2/2002 | Arilla et al. | |

* cited by examiner

*Primary Examiner*—Ninh H. Nguyen
(74) *Attorney, Agent, or Firm*—Oblon, Spivak, McClelland, Maier & Neustadt, P.C.

(57) ABSTRACT

The system retains a plate against a disk presenting in its radial face an annular recess defined by a plurality of walls, one of which is formed by a face of a flange, said plate presenting an annular base pressing against the radially outer wall of the recess and a root which extends from the base into the recess, said system including a split annular retaining ring disposed in the recess. In characteristic manner, said flange presents a top end of crenellated outline provided with at least one notch, said root is provided with a front rim of crenellated outline, having at least one mortise, and a rear rim between which rims there is formed an annular groove for receiving the ring which presents an axial tenon suitable for penetrating into said notch and into said mortise.

6 Claims, 6 Drawing Sheets

SYSTEM FOR RETAINING AN ANNULAR PLATE AGAINST A RADIAL FACE OF A DISK

The invention relates to a system for retaining an annular plate against a radial face of a disk.

More particularly, the present invention relates to a system for retaining an annular plate against a radial face of a disk, the disk presenting in said radial face an annular recess defined by a plurality of walls, one of which is formed by a face of a flange which extends radially outwards, said plate presenting in its radially inner portion an annular base pressing against the radially outer wall of the recess and a root extending radially towards the inside of the recess from the axially inner end of the base, said system including a split annular retaining ring disposed in the recess.

BACKGROUND OF THE INVENTION

At present, amongst the various solutions that are available, there is the solution set out in FR 2 812 906: that solution uses a retaining ring provided with a rabbet on its radially outer face in order to receive a portion of the root. During disassembly, in order to allow the root to be removed from the recess, radial compression is applied to the ring by means of a tool which is inserted in a notch at the radially inner end of the root and which bears against the radially outer face of the ring so as to lower it until the tool comes to bear against the top end of the annular flange adjacent to the annular recess of the disk.

Nevertheless, that solution can lead to the radially inner end of the root of the annular plate being damaged.

OBJECTS AND SUMMARY OF THE INVENTION

An object of the present invention is to provide a system for retaining an annular plate against a radial face of a disk, enabling assembly and also disassembly to be simple without any risk of damaging the plate, and also without requiring recourse to special tooling.

To this end, in the present invention, in characteristic manner, said flange presents a top end of crenellated outline provided with at least one notch, said root is provided in its radially inner portion with a front rim which presents a crenellated outline of shape complementary to the top end of the flange, and a rear rim, said front and rear rims extending radially inwards and defining between them an annular groove, said front rim being provided with at least one mortice, said retaining ring presents on its axially outer face at least one tenon extending in an axial direction and suitable for penetrating in said notch and in said mortice, the rear rim of the root of the plate and said tenon of the retaining ring carry facing annular chamfers for enabling the ring previously disposed in the recess to be compressed radially during axial sliding of the base into the recess during an initial step of mounting the plate on the disk, at the end of which step the ring is retained axially in said groove, and the tenons present respective free ends of transverse width greater than the transverse width of the notches so as to retain the plate axially against the flange when the root of the plate is turned in the recess during a second step of mounting the plate on the disk.

It will thus be understood that it is possible to lock the plate reliably relative to the disk in the axial direction and in rotation.

Also, such an arrangement is easy to implement because of the way the retaining ring is used which is the only part to be subjected to compression (radial compression) during disassembly, the plate being subjected to rotation only, where rotation does not run the risk of damaging the radially inner end of the root of the plate.

Overall, because of the arrangement of the present invention, and in particular because of the presence of the tenon of the retaining ring which is received in the notch of the annular crenellated flange of the disk, it is possible to disassemble and to reassemble the system without special tooling.

Preferably, the section of the ring in the axial direction is of width substantially equal to the width of the groove in the axial direction.

This means that the axial distance between the rear face and the front face of the groove is designed to enable the width in the axial direction of the section of the ring to be inserted therein with practically no clearance.

Preferably, the length of the tenon in the axial direction is greater than the sum of the thickness in the axial direction of the front rim of the root of the plate plus the thickness in the axial direction of the annular flange of the disk.

This gives easy access to the free end of the tenon which projects beyond the flange in the axial direction, thereby facilitating disassembly merely by pressing against said free end of the tenon.

In a preferred disposition, said tenon presents a width that is substantially equal to the width of the mortise of the front rim.

Such an arrangement makes it possible to avoid any clearance between the sides of the tenon and the side walls of the mortice, thus avoiding any shocks between those parts while the disk is in rotation, and thus avoiding premature wear of the retaining ring and the plate.

In another preferred disposition, said tenon presents a width substantially equal to the width of the notch of the flange.

This disposition makes it possible to avoid clearance between the sides of the tenon and the side walls of the notch, thus avoiding any shocks between these parts while the disk is rotating, and thus avoiding any premature wear of the retaining ring and the disk.

In a preferred embodiment, said front rim extends radially over a height that is greater than or equal to the radial thickness of the ring.

In this way, axial thrust (support or bearing) is achieved between the entire surface of the axially outer face of the retaining ring and the front face of the groove, this thrust over a maximum area enabling the stress exerted in the axial direction on the retaining ring to be minimized.

BRIEF DESCRIPTION OF THE DRAWINGS

Other advantages and characteristics of the invention appear on reading the following description made by way of example and with reference to the accompanying drawings, in which.

MORE DETAILED DESCRIPTION

Figure 1B:
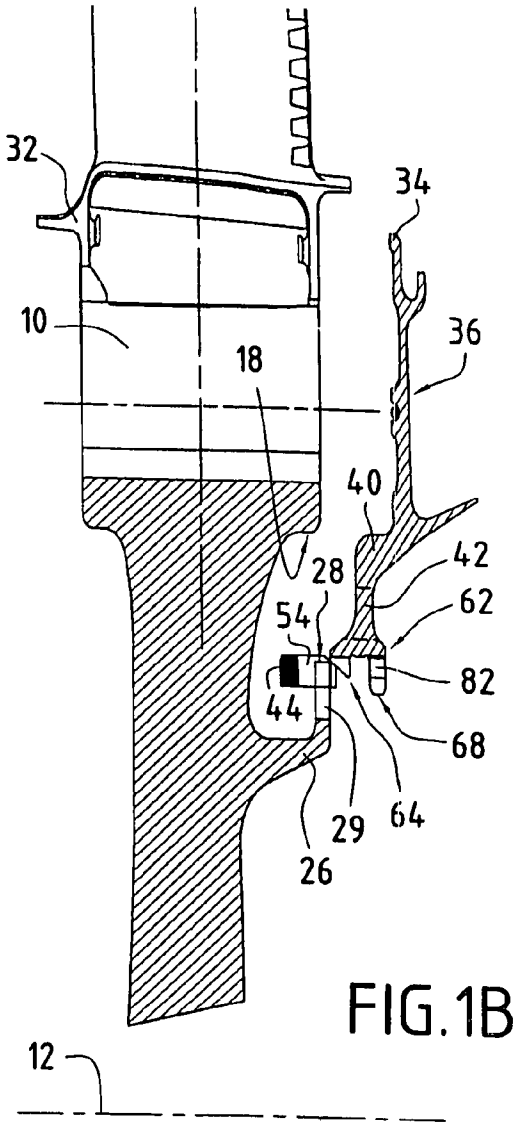
FIG. 1B is a section view of FIG. 1A on line IB—IB.
Figure 1A:
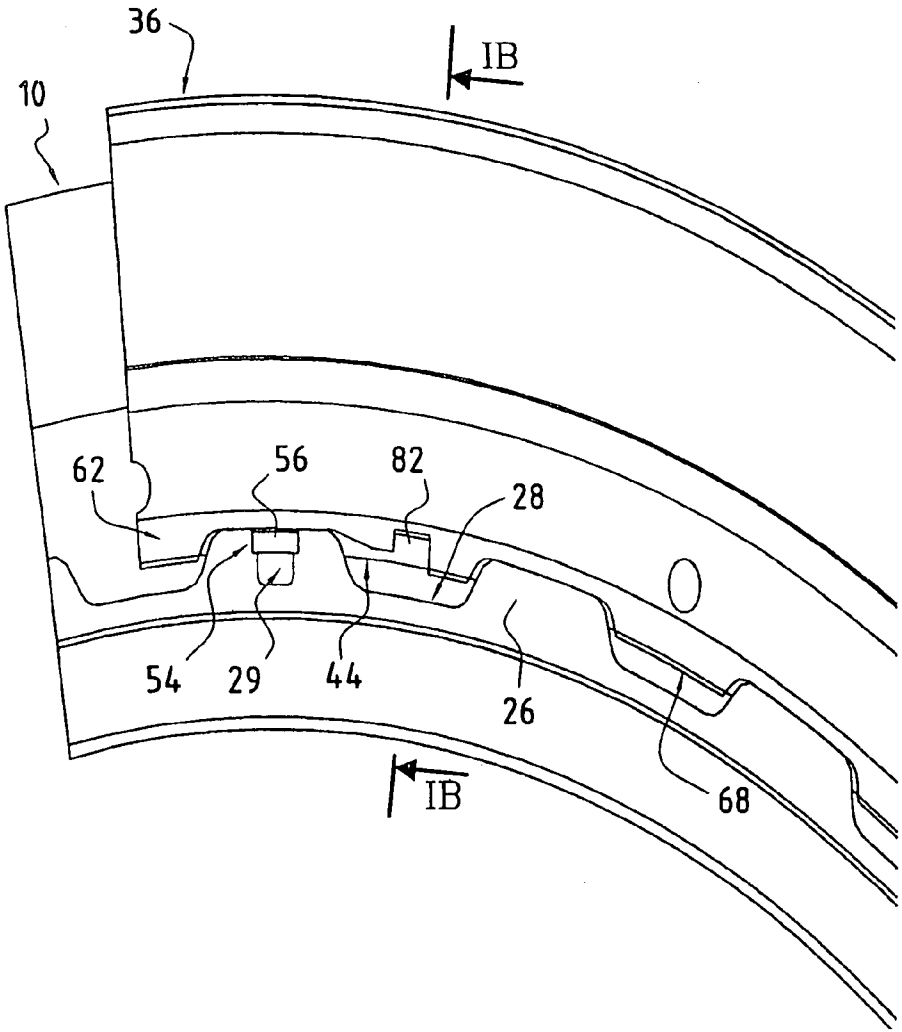
FIG. 1A is a fragmentary projection view of a rotor disk which, prior to assembly, includes a system of the present invention.
Figure 1C:
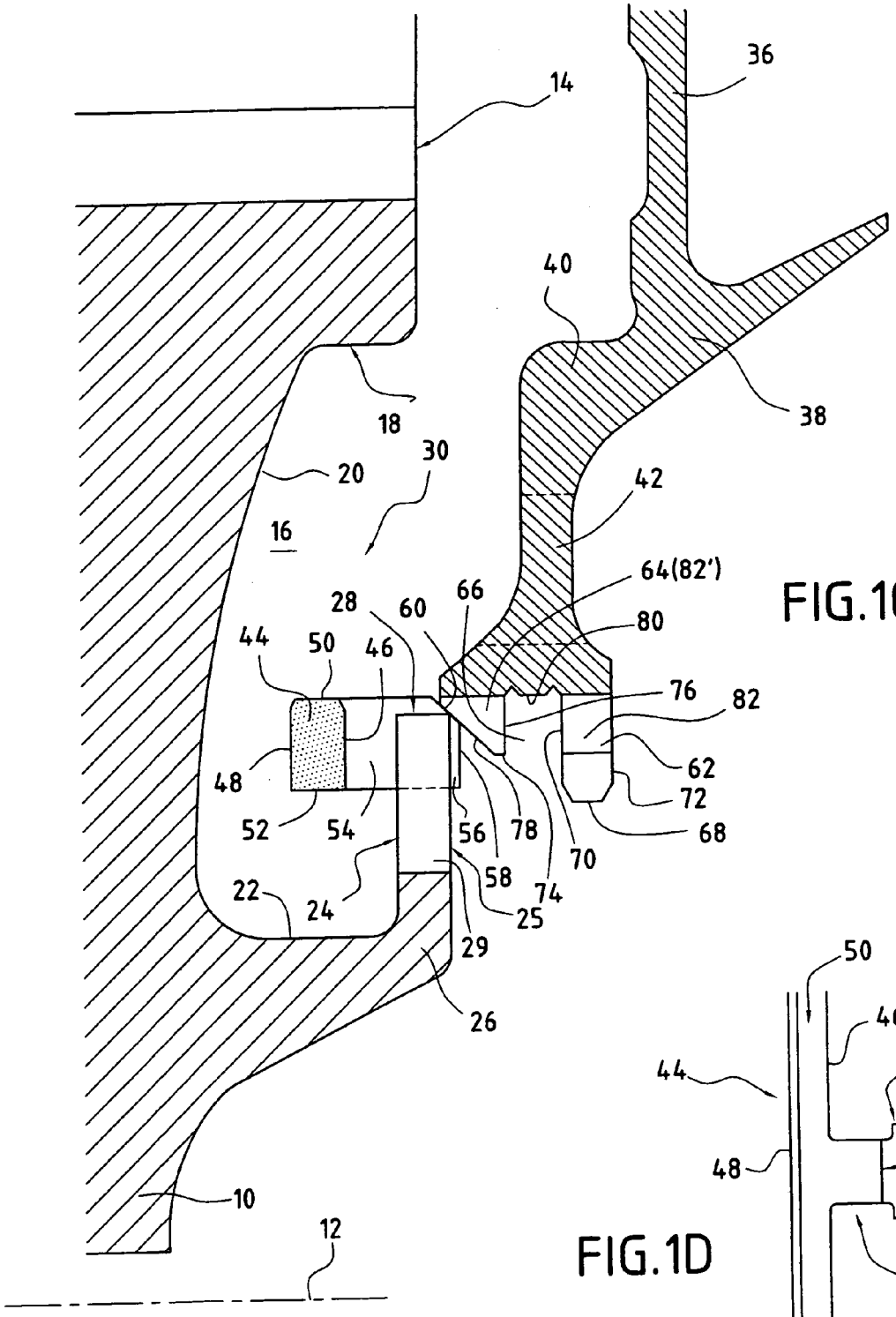
FIG. 1C is a section view on a larger scale showing a portion of FIG. 1B in greater detail.
Figure 1D:
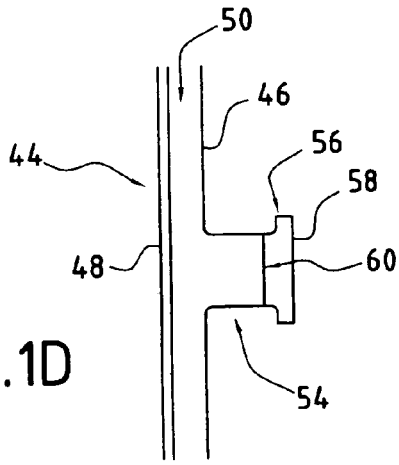
FIG. 1D is a plan view in a radial direction of the retaining ring.

In the figures, and in particular in FIG. 1C, there can be seen a rotor disk 10 of a gas turbine engine having an axis of rotation 12.

On its radial face 14, this disk 10 presents a recess 16 defined by a radially outer wall 18, an axially inner wall 20, a radially inner wall 22, and the inside face 24 of an annular flange 26 which extends radially outwards from the radially inner wall 22.

The top end 28 of the annular flange 26 is radially distant from the radially outer wall 18 so as to leave a circular opening 30 giving access to the recess 16.

Notches 29 of U-shaped outline that are open to the top end 28 of the annular flange 26 are formed through the entire thickness of the annular flange 26 and are disposed at regular intervals all around the flange 26. These notches 29 extend radially from the top end 28 of the annular flange 26 to a distance enabling an annular plate 36 to be inserted in a manner explained below.

At its periphery, the disk 10 includes indentations such as axial notches for receiving blade roots 32 as can be seen in FIGS. 1B, 2B, 3B, and 4B. These blade roots are prevented from moving axially by the radially outer portion 34 of the annular plate 36 whose radially inner portion 38 has an annular base 40 which extends axially into the outer region of the recess 16 and a root 42 which extends radially towards the axis of rotation 12 and axially towards the outside of the recess 16 from the inside end of the annular base 40.

The outside diameter of the annular base 40 is substantially equal to the diameter of the radially outer wall 18 of the recess 16 and the annular base 40 bears in sliding manner against said outer wall 18.

The top end 28 of the annular flange 26 presents a crenellated or festooned outline formed, in the radial direction, by a regular alternation of indentations and projections forming a series of undulations, as can be seen in FIGS. 1A, 2A, 3A, and 4A.

It should be observed that the notches 29 are situated in the projecting zones of the crenellated outline of the annular flange 26.

In order to enable the annular base 40 of the root 42 to be inserted through the annular opening 30 into the recess 16, the distance between the outside diameter of the annular base 40 of an indentation (or a projection) of the end face 68 of the front rim 62 is firstly greater than the distance between the radially outer wall 18 of a projection (or an indentation) of the top end 28 of the flange 26, and secondly smaller than the distance between the radially outer walls 18 of the bottoms of the notches 29 in the flange 26.

When the radially inner portion 38 of the annular plate 36 is inserted into the recess 16, the plate 36 is prevented from moving radially relative to the disk 10 because its annular base 40 bears in sliding manner against the radially outer wall 18.

The plate 36 is held axially on the disk 10 by a split annular retaining ring 44.

As can be seen in FIG. 1C, the split annular retaining ring 44 presents an axially outer face 46, an axially inner face 48, a radially outer face 50 connected to the axially outer face 46 and to the axially inner face 48, and a radially inner face 52.

The diameter of the radially inner face 52 is greater than the diameter of the radially inner wall 22 of the recess 16, and less than the diameter of a projection at the top end 28 of the flange 26, by a distance that enables the retaining ring 44 to be retracted behind the annular flange 26 by being compressed while the plate 36 is being put into place.

The split annular retaining ring 44 also presents tenons 54 extending axially outwards from the axially outer face 46 in line with the radially outer face 50 and the radially inner face 52, each having a free end 56 that is enlarged transversely relative to the axis of rotation 12.

The width in the transverse direction of these tenons 54 enables them to be inserted into respective corresponding notches 29, with the enlarged end 56 of each tenon being retained axially by the annular flange 26 because said enlarged end 56 is of a length in the transverse direction that is greater than the width of the notches 29.

The notches 29 are regularly distributed at an angular spacing equal to the angular spacing between two consecutive tenons 54 of the retaining ring 44.

The front face 58 of the enlarged end 56 of a tenon 54 is connected to the radially outer face 50 by a chamfer 60.

As can be seen more clearly in FIG. 1C, the root 42 of the annular plate 36 presents a radially inner end provided with a front annular rim 62 and a rear annular rim 64 with an annular groove 66 being defined between them and having an axis of symmetry of revolution that is parallel to the axis of rotation 12.

In cross-section, the annular groove 66 presents a U-shape with its open side facing towards the axis of rotation 12.

The front annular rim 62 is defined by an end face 68, a front face 70 of the annular groove 66, and a front face 72. The end face 68 facing towards the axis of rotation 12 connects the front face 70 of the annular groove 66 to the front face 72 of the front annular rim 62.

The rear annular rim 64 is defined by an end face 74, a rear face 76 of the annular groove 66, and a chamfer 78. The end face 74 facing towards the axis of rotation 12 connects the rear face 76 of the annular groove 66 to the chamfer 78 of the rear annular rim 64.

The chamfers 60 of the tenons 54 and the chamfer 78 of the rear annular rim 64 of the root 42 of the annular plate 36 are at identical angles relative to the axis of rotation 12 of the disk 10, lying in the range 10° to 45°.

The annular groove 66 is thus defined by the front face 70, the rear face 76, and by an annular bottom wall 80 facing towards the axis of rotation 12.

In addition, it should be observed that the axially outer face 46 of the retaining ring 44 is designed to bear against the front face 70 of the annular groove 66.

Also, the axially inner face 48 of the split retaining ring 44 is designed to bear against the rear face 76 of the annular groove 66.

In addition, the radially outer face 50 of the split retaining ring 44 is designed to bear against the annular bottom 80 of the annular groove 66.

In its radially inner portion of the front annular rim 62, the root 42 of the plate 36 presents a crenellated outline that is complementary in shape to the top end 28 of the flange 26.

As can be seen in FIGS. 1A, 2A, 3A, and 4A, the end face 68 of the front rim 62 is formed in the radial direction by a regular alternation of indentations and projections forming a series of undulations that can be seen from outside the disk 10 (from the right-hand side of FIGS. 1B, 2B, 3B, 4B, 1C, and 4C).

Mortises (slots) 82 are formed in the front annular rim 62 that are regularly spaced apart at an angular interval equal to the interval between two consecutive tenons 54 of the retaining ring 44.

These mortises 82 are directed parallel to the axis of rotation 12 and they are U-shaped in cross-section with the open side of the U-shape turned towards the axis of rotation 12.

These mortises 82 are also situated at the locations of the projections of the crenellated outline of the end face 68 of the front rim 62.

For reasons of ease of fabrication during machining, these mortises 82 made in the front annular rim 62 are in alignment with corresponding mortises (slots) 82' in the rear annular rim 64.

It can be seen that the width in the axial direction parallel to the axis of rotation 12 of the cross-section of the annular ring 44 is substantially equal or slightly less than the width in the axial direction of the annular groove 66. This disposition makes it possible to house the annular ring 44 in the annular groove 66 with no clearance or practically no clearance.

It should also be observed that the length in the axial direction of the tenon 54, i.e. the distance between the axially outer face 46 of the retaining ring 44 and the front face 58 of the enlarged end 56, is greater than the sum of the thickness in the axial direction of the front rim 62 of the root of the plate plus the thickness in the axial direction of the annular flange 26 of the disk 10. In this way, in addition to the above-described disposition, it will be understood that the retaining ring 44 enables the annular plate 36 to be retained axially on the flange 26 of the disk 10.

According to an essential characteristic, in order to retain the annular plate axially against the disk 10 in the recess 16, the free end 56 of each tenon 54 is enlarged so as to reach a width in a transverse direction (perpendicular to the longitudinal direction 12 and to the radial direction) that is greater than the width of each notch 29 in the transverse direction.

In this manner, after assembly, the rear face of the free end 56 of each tenon 54 comes to bear against the outer face 25 of the annular flange 26.

It should also be observed that each tenon 54 is of a width in a transverse direction perpendicular to the axis of rotation 12 that is substantially equal to or slightly less than the width in the transverse direction of a mortise 82 in the front rim 62. In addition, each tenon 54 is of a width in a transverse direction that is substantially equal to or slightly less than the width in the transverse direction of a notch 29 in the flange 26.

In this way, each tenon 54 which is received both in a notch 29 of the annular flange 26 and in a mortise 82 of the front annular rim 62 of the root 42 of the plate 36 serves to prevent the plate 36 and the disk 10 from turning relative to each other, and does so with little or no clearance.

Furthermore, the front rim 62 extends radially over a height which is greater than or equal to the radial thickness of the retaining ring 44: this guarantees maximum contact area and thus minimum axial stress between the axially outer face 46 of the retaining ring 44 and the front rim of the plate 36, and more precisely the front face 70 of the groove 66.

Various stages in mounting the plate 36 on the disk 10 are described below with reference to FIGS. 1A to 4C.

The annular retaining ring 44 is enlarged and then received in the recess 16, with the tenons 54 being placed in respective corresponding notches 29 of the flange 26. The annular retaining ring 44 automatically takes up a rest position as shown in FIGS. 1A to 1C once the radial force holding it split open ceases to be exerted.

In this position, the diameter of the radially outer face 50 of the split annular retaining ring 44 is greater than the diameter of the projections in the crenellated outline forming the top end 28 of the annular flange 26.

Likewise, in the situation that can be seen in FIGS. 1A to 1C, the annular flange 26 thus retains the retaining ring 44 in the axial direction since when the retaining ring 44 moves axially to the right in FIG. 1B or FIG. 1C, the inside face 24 of the flange 26 comes to bear against the axially outer face 46 of the retaining ring 44, and when the retaining ring 44 is moved axially to the left in FIG. 1B or FIG. 1C, then it is the outside face 25 of the flange 26 that comes to bear against the rear faces of the enlarged ends 56 of the tenons 54.

Naturally, this situation is due to the fact that the width in the transverse direction of the free end 56 of each tenon 54 is greater than the width in the transverse direction of the notches 29.

The plate 36 is then positioned so that its root 42 is situated facing the annular opening 30 of the recess 16. The chamfer 78 of the rear rim 64 of the root 42 then comes to bear against the chamfer 60 on each tenon 52 of the retaining ring 44. In this position, as can be seen in FIGS. 1A to 1C, the retaining ring 44 is centered relative to the axis of rotation 12 of the disk 10.

Figure 2B:
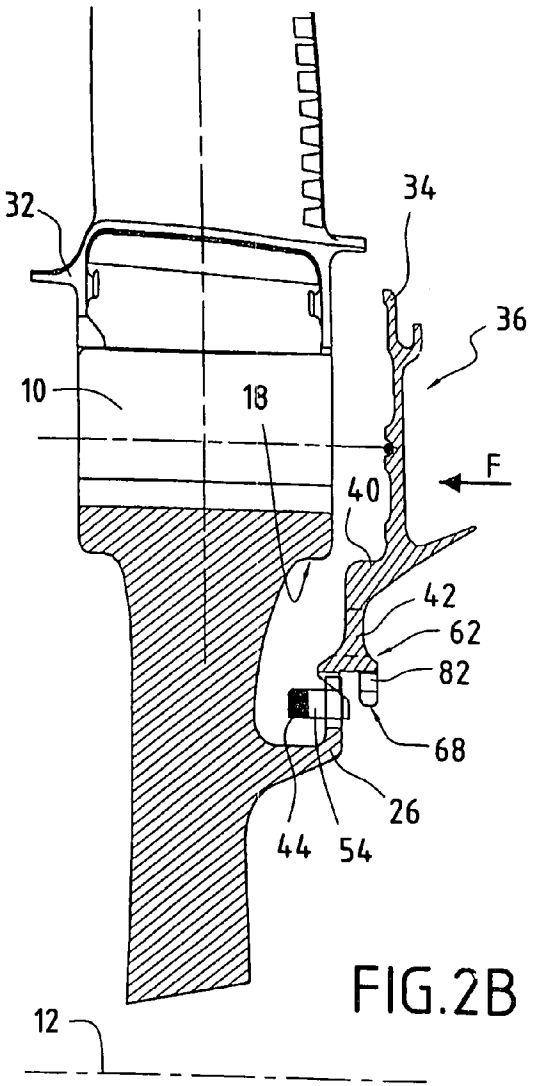
FIGS. 2A and 2B are views similar to FIGS. 1A and 1B during a first step of mounting the annular plate on the disk.
Figure 2A:
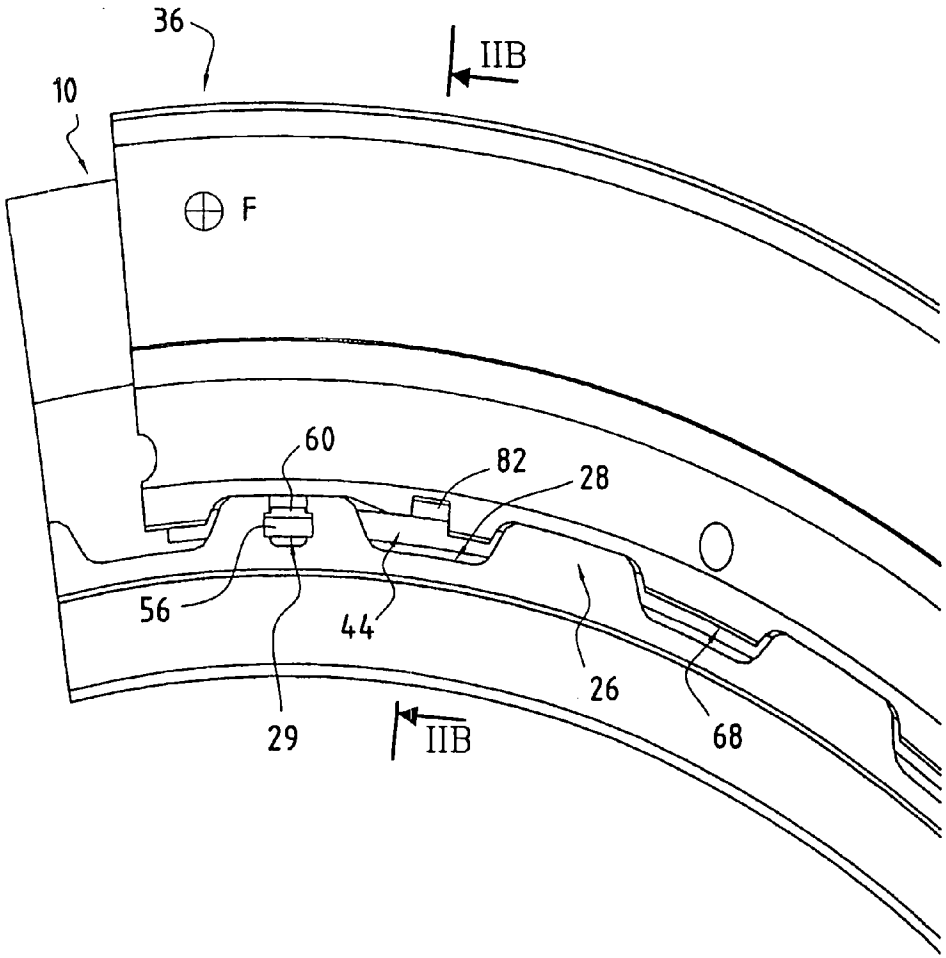

In the following step, shown in FIGS. 2A and 2B, an axial force F is applied to the annular plate, e.g. to the top portion thereof, thus leading to the retaining ring 44 being compressed radially and to the annular base 40 of the plate 36 moving axially towards the recess 16, and in particular towards the axially inner wall 20 and the radially outer wall 18 of the recess 16.

It will be understood that the radial compression of the retaining ring 44 is due to the chamfers 60 and 78 sliding over each other.

Figure 3B:
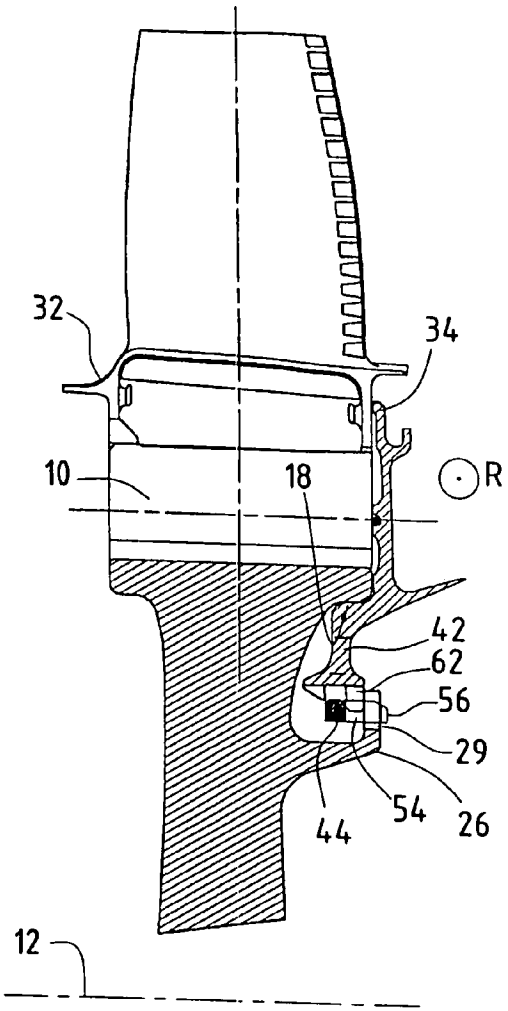
FIGS. 3A and 3B are views similar to those of FIGS. 1A and 1B during a second step of mounting the annular plate on the disk.
Figure 3A:
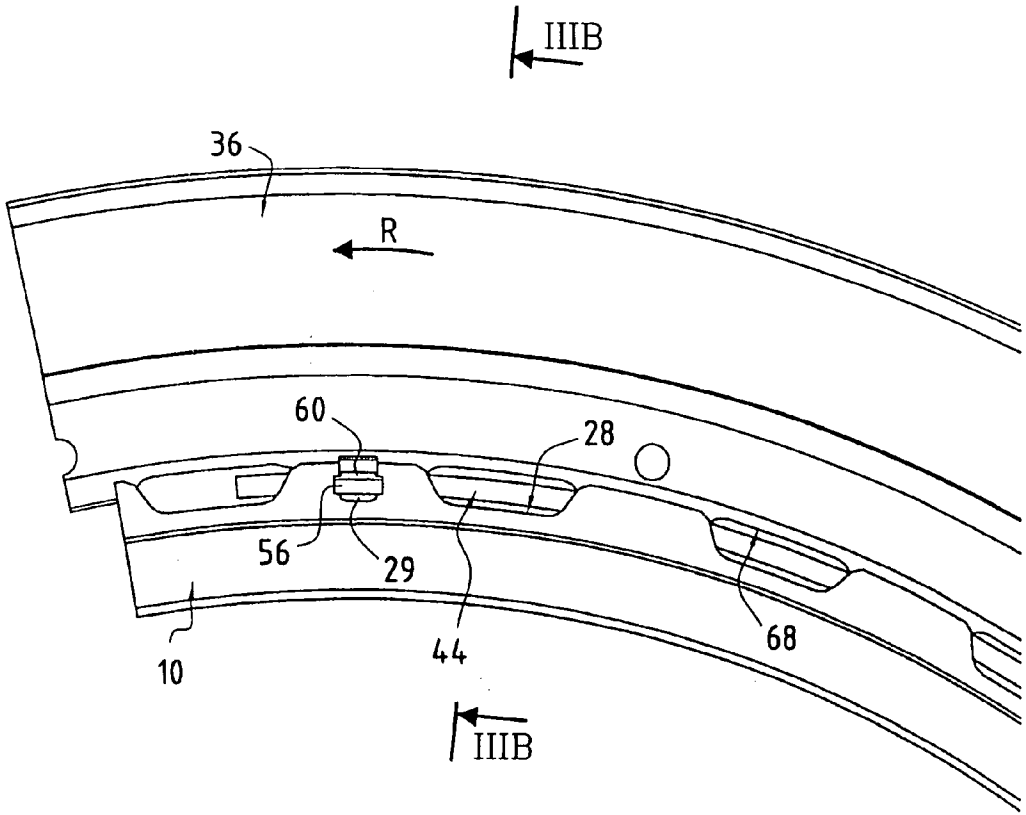

During this approach, the annular base 40 of the plate 36 slides against the radially outer wall 18 of the recess until it comes close enough to the axially inner wall 20 to reach the position shown in FIGS. 3A and 3B, where the top portion of the plate 36 comes to bear against the radial face 14 of the disk 10 and the roots 32 of the blades.

In this position shown in FIGS. 3A and 3B, since the rear rim 64 and then the front rim 62 have moved successively past the flange 26 by penetrating into the recess 16, the situation is reached in which the retaining ring 44 is received in the annular groove 66 and the front annular rim 62 becomes interposed between the retaining ring 44 and the annular flange 26.

Figure 4B:
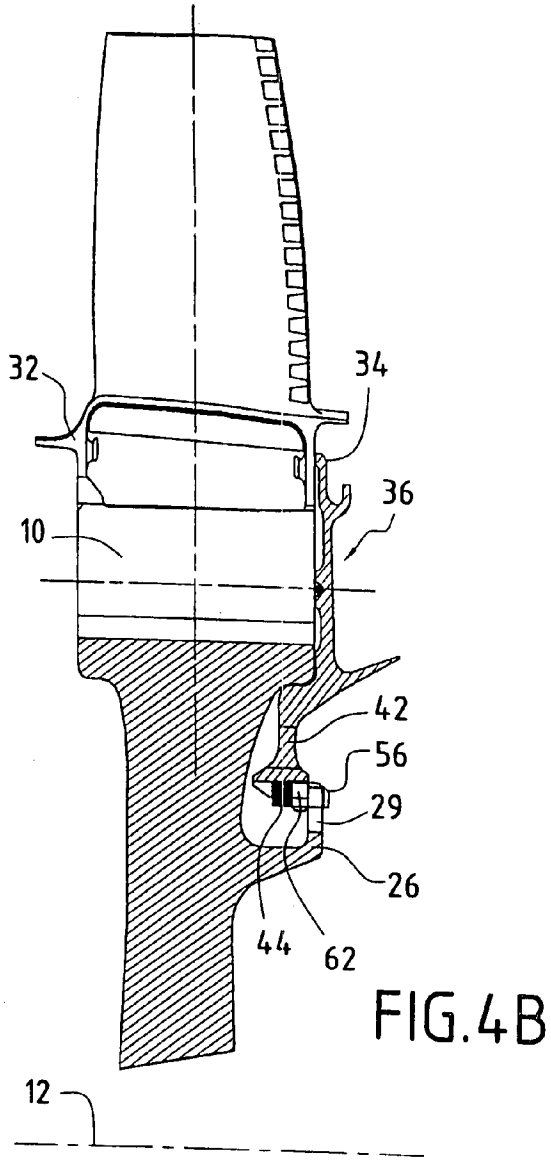
FIGS. 4A, 4B, and 4C are views similar to those of FIGS. 1A, 1B, and 1C once mounting has been completed.
Figure 4A:
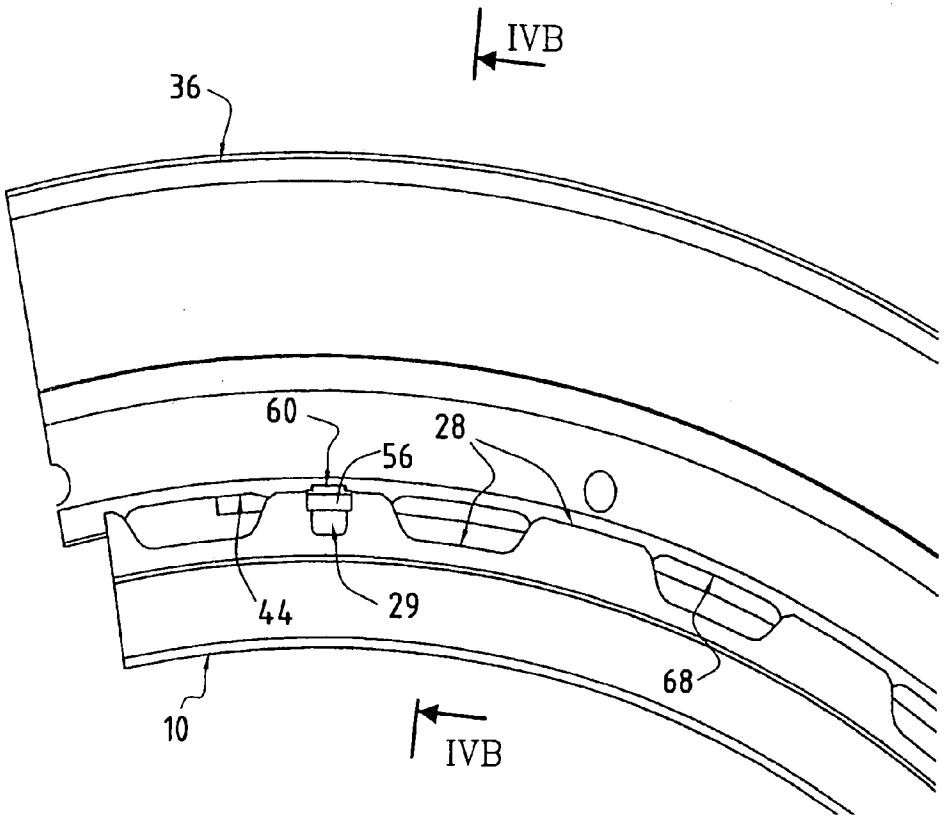
Figure 4C:
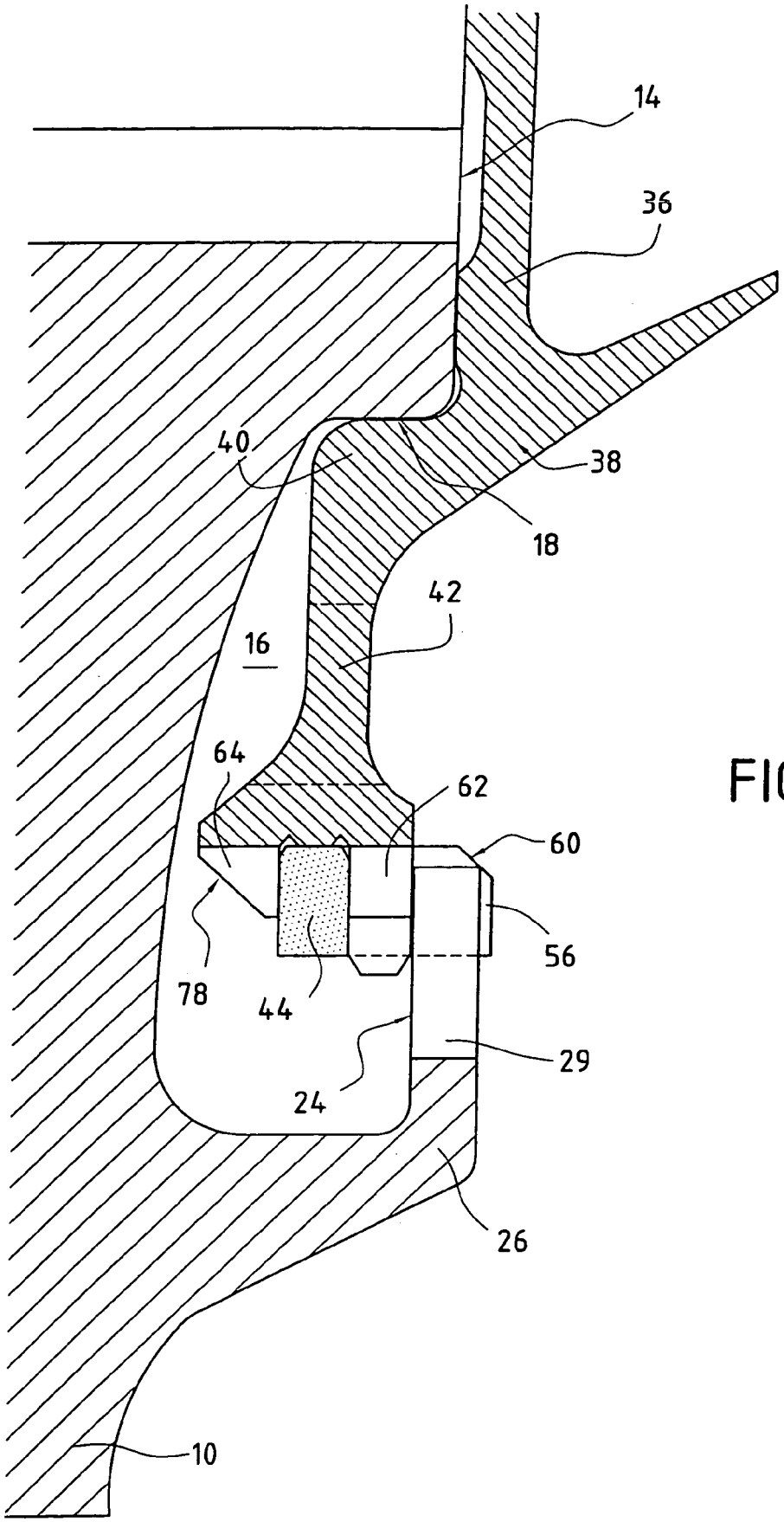

Thereafter, the retaining ring 44 relaxes, expanding radially until it comes to bear against the bottom wall 80 of the annular groove 66 (FIGS. 4A, 4B, and 4C).

The plate 36 is preferably mounted on the disk 10 with axial prestress.

As can be seen in FIGS. 3A and 3B, the plate 36 is also turned (arrow R) relative to the disk so that after mounting it reaches the situation that is shown in FIGS. 4A, 4B, and 4C. The mortises 82 in the front rim 62 then overlie the tenons 54, thus enabling the retaining ring 44 to relax, expanding radially until it comes to bear against the bottom wall 80 of the annular groove 66.

In this situation, the tenons 54 of the retaining ring 44 serve as keys between the plate 36 and the flange 26 of the disk 10 which are then connected to each other with a system that is similar to a bayonet fastening, by a combination of axial engagement and turning.

The plate 36 is prevented from moving relative to the disk 10 firstly in an axial direction by the front face 72 of the front rim 62 bearing against the inside face 24 of the crenellated annular flange 26, with this happening only after the second mounting step in which the plate 36 is turned relative to the disk 10 through an angle such as the angle forming the angular interval between the indentations (or projections) of the top ends 28 of the annular flange 26 or the end face 68 of the front rim 62.

Furthermore, the plate 36 is prevented from turning relative to the disk 10 because of the tenons 54 received in the notches 29 of the flange 26 and in the mortises 82 of the front rim 62.

In order to disassemble the plate 36 easily from the disk 10, it is necessary to perform the above-described operations in the reverse order. Thus, disassembly is performed by a first operation consisting in turning the plate 36 (in the direction opposite to that of the arrow R in FIGS. 3A and 3B) and by a second operation consisting in pressing on the chamfer 60 so as to compress the ring 44 axially and allow the plate 36 to be disengaged.

In this way, it will be understood that it is possible to make do without special tooling when mounting and removing the plate, and in addition the disk is not stressed during mounting and removal steps so it is not subjected to stress outside its periods of operation, thereby increasing its lifetime.

What is claimed is:

1. A system for retaining an annular plate against a radial face of a disk, the disk presenting in said radial face an annular recess defined by a plurality of walls one of which is formed by a face of a flange which extends radially outwards, said plate presenting in its radially inner portion an annular base pressing against the radially outer wall of the recess and a root extending radially towards the inside of the recess from the axially inner end of the base, said system including a split annular retaining ring disposed in the recess, wherein said flange presents a top end of crenellated outline provided with at least one notch, wherein said root is provided in its radially inner portion with a front rim which presents a crenellated outline of shape complementary to the top end of the flange, and a rear rim, said front and rear rims extending radially inwards and defining between them an annular groove, said front rim being provided with at least one mortice, wherein said retaining ring presents on its axially outer face at least one tenon extending in an axial direction and suitable for penetrating in said notch and in said mortice, wherein the rear rim of the root of the plate and said tenon of the retaining ring carry facing annular chamfers for enabling the ring previously disposed in the recess to be compressed radially during axial sliding of the base into the recess during an initial step of mounting the plate on the disk, at the end of which step the ring is retained axially in said groove, and wherein the tenons present respective free ends of transverse width greater than the transverse width of the notches so as to retain the plate axially against the flange when the root of the plate is turned in the recess during a second step of mounting the plate on the disk.

2. A system according to claim 1, wherein the width of the section of the ring in the axial direction is substantially equal to the width of the groove in the axial direction.

3. A system according to claim 1, wherein the length of the tenon in the axial direction is greater tan the sum of the thickness in the axial direction of the front rim of the root of the plate plus the thickness in the axial direction of the annular flange of the disk.

4. A system according to claim 1, wherein said tenon presents a width that is substantially equal to the width of the mortise of the front rim.

5. A system according to claim 1, wherein said tenon presents a width substantially equal to the width of the notch of the flange.

6. A system according to claim 1, wherein said front rim extends radially over a height that is greater than or equal to the radial thickness of the ring.

* * * * *